United States Patent [19]

Kosak et al.

[11] Patent Number: 5,020,354

[45] Date of Patent: Jun. 4, 1991

[54] COMPACT ROLLING MILL FOR ROLLING STRUCTURAL STEEL

[75] Inventors: Dietmar Kosak, Neuss; Wolfgang Ellinghaus, Kaarst; Hugo Feldmann, Alsdorf-Warden; Georg Engel, Kaarst, all of Fed. Rep. of Germany

[73] Assignee: SMS Schloemann-Siemag Aktiengesellschaft, Düsseldorf, Fed. Rep. of Germany

[21] Appl. No.: 243,441

[22] Filed: Sep. 12, 1988

[30] Foreign Application Priority Data

Sep. 11, 1987 [DE] Fed. Rep. of Germany ..... 3730471

[51] Int. Cl.[5] ..... B21B 1/10; B21B 13/10

[52] U.S. Cl. ..... 72/225; 72/229; 72/235; 72/239

[58] Field of Search ..... 72/225, 227, 228, 229, 72/231, 235, 239, 238

[56] References Cited

U.S. PATENT DOCUMENTS

| | | | |
|---|---|---|---|
| 4,291,564 | 9/1981 | Muckli | 72/225 X |
| 4,370,877 | 2/1983 | Michaux | 72/225 X |
| 4,400,962 | 8/1983 | Michaux | 72/225 X |
| 4,615,200 | 10/1986 | Michaux | 72/225 |
| 4,637,241 | 1/1987 | Michaux | 72/225 |
| 4,791,799 | 12/1988 | Engel et al. | 72/225 |

FOREIGN PATENT DOCUMENTS

| | | | |
|---|---|---|---|
| 1452150 | 12/1968 | Fed. Rep. of Germany | 72/228 |
| 1427875 | 10/1969 | Fed. Rep. of Germany . | |
| 3627729 | 2/1988 | Fed. Rep. of Germany . | |
| 86964 | of 1951 | U.S.S.R. . | |
| 806167 | 2/1981 | U.S.S.R. . | |

OTHER PUBLICATIONS

Zelikow, A. I. et al., 1972, pp. 56 & 58.

Zelikow A. I. et al., 1958, pp. 19, 18, 163.

*Primary Examiner*—E. Michael Combs

*Attorney, Agent, or Firm*—Toren, McGeady & Associates

[57] ABSTRACT

A compact rolling mill for rolling sections includes rolling stands such as universal rolling stands and two-high rolling stands arranged along several rolling lines. Provided in the rolling lines are longitudinal conveyors for transporting the rolling stock along these rolling lines and cross conveyors for transporting the rolling stock between the rolling lines. At least two universal rolling stands are combined with one two-high edging stand to define a universal tandem compact group which together with further universal stands and two-high rolling stands may be displaced from one rolling position to another rolling position in a same rolling line or in a different rolling line. The drive unit is directly coupled to the stands along the outermost rolling line while the other remaining stands are indirectly connected to the drive unit transversely across the other rolling lines via other rolling stands.

2 Claims, 15 Drawing Sheets

COMPACT ROLLING MILL FOR ROLLING STRUCTURAL STEEL

BACKGROUND OF THE INVENTION

The present invention refers to a compact rolling mill for rolling structural steel through rolling stands arranged in several rolling lines. In addition, the present invention refers to a method for rolling structural steel in such rolling mills.

Compact rolling mills of this type include universal rolling stands and two-high rolling stands with conveyors for longitudinally transporting a rolling stock in a rolling line and conveyors for transporting the rolling stock between rolling lines, as well as guiding devices for the rolling stock during its travel between the stands. In contrast to large and expensive shape mill trains which have a great demand on space, especially in longitudinal extension, and allow the rolling of only one profile so as to be usable in an economic manner only when rolling at high production, compact rolling mills are applicable for a wide range of section rolling, including beams, rails and sheet piles, and can be run in an economic manner also at smaller production quantities.

Known rolling mills of this type which only include universal stands and possibly two-high edging stands incur, however, high expenses and operating costs when covering a wide program so that a high output of beams or rail is required to render the operation economical.

It has been proposed to use a combination of universal stands and two-high stands for rolling the profile program which lead to a limited, yet not sufficient increase of available grooves but resulted also in increased barrel lengths of the two-high rolls, wider roller tracks and larger cross conveyors. In addition, the substantial length of roll barrels lead to sagging of the rolls and thus impaired stiffness of the stands. To counter this drawback, rolling stands with variable distance of the roll support i.e. shiftable rolling stands have been proposed. This, however, also lead to high expenditures and high operating costs when changing the unit.

The use of additional two-high rolling stands for broadening the production program incurred also high investments and a considerably increased demand on space so that the production of at least some sections must be increased to render the overall program economical.

SUMMARY OF THE INVENTION

It is thus an object of the present invention to provide an improved compact rolling stand for rolling structural steel obviating the afore-stated drawbacks.

This object and other which will become apparent hereinafter are attained by combining at least two universal stands with one two-high edging stand to define a universal tandem compact stand group, with the latter and further universal rolling stands and two-high rolling stands selectively displaceable from one rolling position to another rolling position which may be in a same rolling line or in a different rolling line. A drive unit is directly coupled to the rolling stands along the outermost rolling line while the other remaining stands are indirectly connected to the drive unit transversely across the other rolling lines via other rolling stands.

Rolling stands, drive unit as well as longitudinal conveyors or cross conveyors and possibly centering units may preferably be arranged either individually or in groups in special transport devices. Suitably, the universal rolling stands or groups of universal rolling stands such as the groups of universal tandem compact stands may be transferred by special cranes or groups of cranes extending transversely to the rolling lines.

According to a further feature of the invention, shafting supports are provided between rolling stands arranged in rolling lines other than the main rolling line and the drive units connected to the main rolling line. The drive shafts of the rolling stands may include at roll side axially displaceable guide sleeves and/or joint heads.

Through the provision of a compact rolling mill according to the invention, a suitable increase of the number of possible roll grooves, or the addition of finishing grooves for the two-high roll-forming is possible. During rolling of rails with universal rolling mills, a leader pass or one or more edging passes may additionally be carried out. Without the use of a two-high roughing stand, small continuous casting profiles or when providing a two-high vertical edging stand also larger continuous casting profiles can be adjusted and then directly fed for universal rolling. For displacing the stands, especially the universal stands from one position into another position and also for replacing sets of rolls, stands are preferably used which allow an upward lifting of the sets of rolls.

Advantageously, existing rolling mills can easily be converted and expanded step-by-step to a compact rolling mills according to the invention so as to allow a much broader production program for sections.

According to one embodiment of the present invention, a compact rolling mill includes a universal tandem compact stand group in the main rolling line, three two-high rolling stands in the second rolling line and a two-high edging stand in the third rolling line, with the two-high rolling stands being connectable with the drive unit via the rolling stands of the universal tandem compact group stand, and the two-high edging stand being connectable with the drive unit via one of the two-high rolling stands and one rolling stand of the universal tandem compact group stand. A compact rolling mill of this type allows a rolling of beams with all rolling passes including the guide pass through the universal tandem compact stand group in the main rolling line while all other rolling stands remain disengaged from the drive unit.

By repositioning the arrangement of the compact rolling mill, e.g. by transferring one of the universal rolling stands from the main rolling line into the third rolling line and introducing a shafting support in the original position of this transferred universal rolling stand, such a compact rolling mill is applicable for roll-forming, in particular of sheet piles, by providing in reversing manner the first difficult shaping passes through the universal rolling stand still in the main rolling line and the two-high edging stand while the subsequent shaping passes are attained by the universal rolling stand transferred into the third rolling line and the two-high edging stand, and the finishing passes are carried out continuously in succession through the three finish-grooved two-high rolling stands in the second rolling line.

A compact rolling mill according to the invention may also be usable for the thermomechanic rolling. i.e. rough-rolling at normal temperatures of about 1100° to 1000° C. and final shaping with drafts between 30 and 40% at a temperature of 800° C. and less, to achieve specific structural features.

According to yet another feature of the present invention, the preshaped rolling bar may be transferred to and placed on a cross conveyor during preshaping of a subsequent rolling bar and subjected to an additional air cooling and/or water cooling. For example during rolling of beams, the rough-rolled beam is picked up prior to the finishing pass by a cross conveyor from a longitudinal conveyor associated to the universal tandem compact stand group and is cooled on the cross conveyor until the finish-rolling of the subsequent beam. When the cross conveyor picks up the subsequent beam, the preceding beam is transferred from this cross conveyor to a longitudinal conveyor of the second rolling line and returned by a second cross conveyor to a longitudinal conveyor of the main rolling line for finish-rolling through the universal tandem compact stand group.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
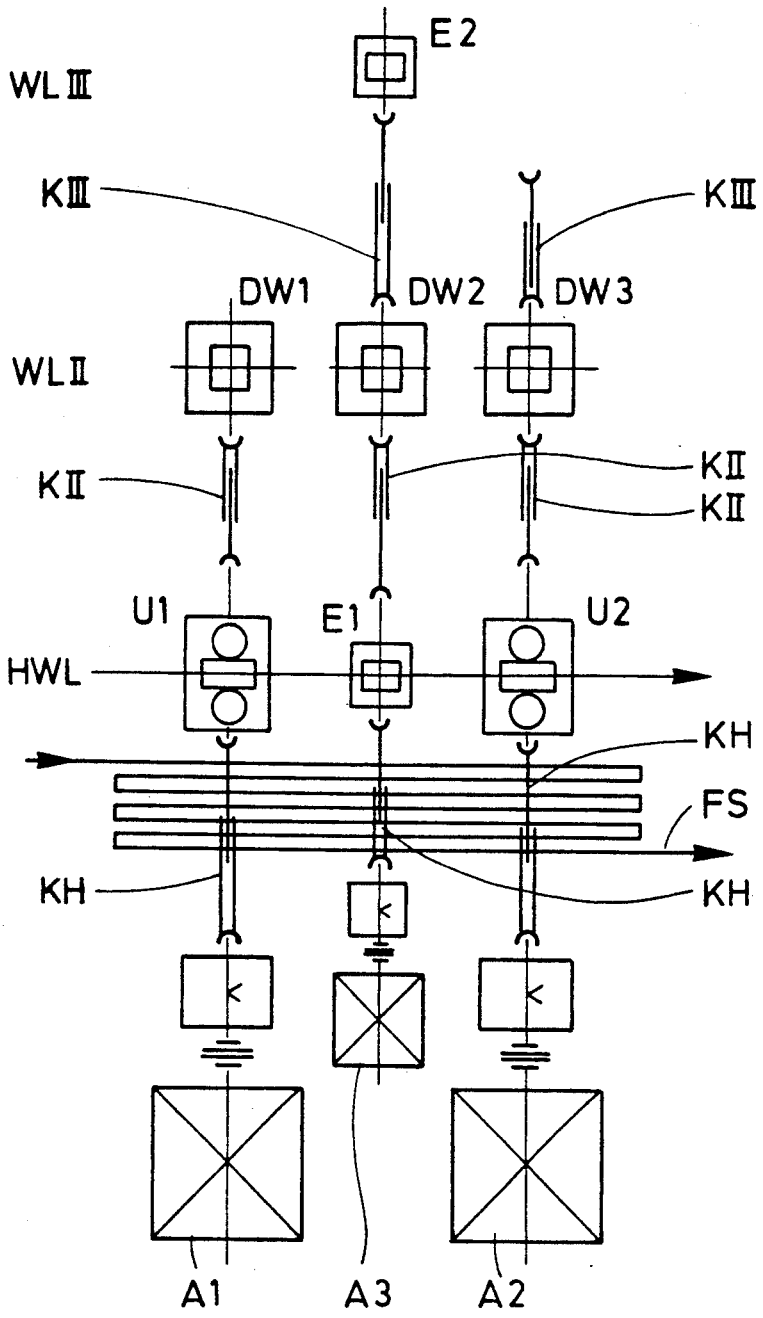
FIG. 1 is a schematic top view of a first embodiment of a compact rolling mill in accordance with the invention, with illustration of the pass course.

Referring now to the drawing, and in particular to FIG. 1, there is shown a schematic top view of a first embodiment of a compact rolling mill in accordance with the invention. The rolling mill has three rolling lines, with the main rolling line HWL including two universal stands U1, U2 and a two-high edging stand E1 arranged therebetween. Both universal stands U1, U2 are driven via clutches KH by drive units Al, A2 while the two-high edging stand E1 is driven by the drive unit A3 via respective clutch KH.

Extending parallel to the main rolling line HWL is the second rolling line WLII where two-high rolling stands DW1, DW2 and DW3 are arranged and spaced at a same distance from each other. The two-high rolling stands DW1, DW2 and DW3 are connectable to the drive units Al, A2, A3 via the respective universal rolling stands U1, U2 and suitable clutches KII which are illustrated in FIG. 1 in disengaged position. The third rolling line WLIII includes a two-high edging stand E2 in axial alignment with the central two-high rolling stand DW2 in the second rolling line WLII and coupled to the latter via clutch KIII.

In the arrangement according to FIG. 1, the compact rolling mill is used for rolling beams in which all passes up to the finishing pass FS in the main rolling line HWL are reversibly carried out through the universal rolling stands U1, U2 and through the two-high edging stand E1 arranged therebetween. The other rolling stands DW1, DW2, DW3 and E2 are disengaged from the drive units Al, A3, A2.

Figure 2:
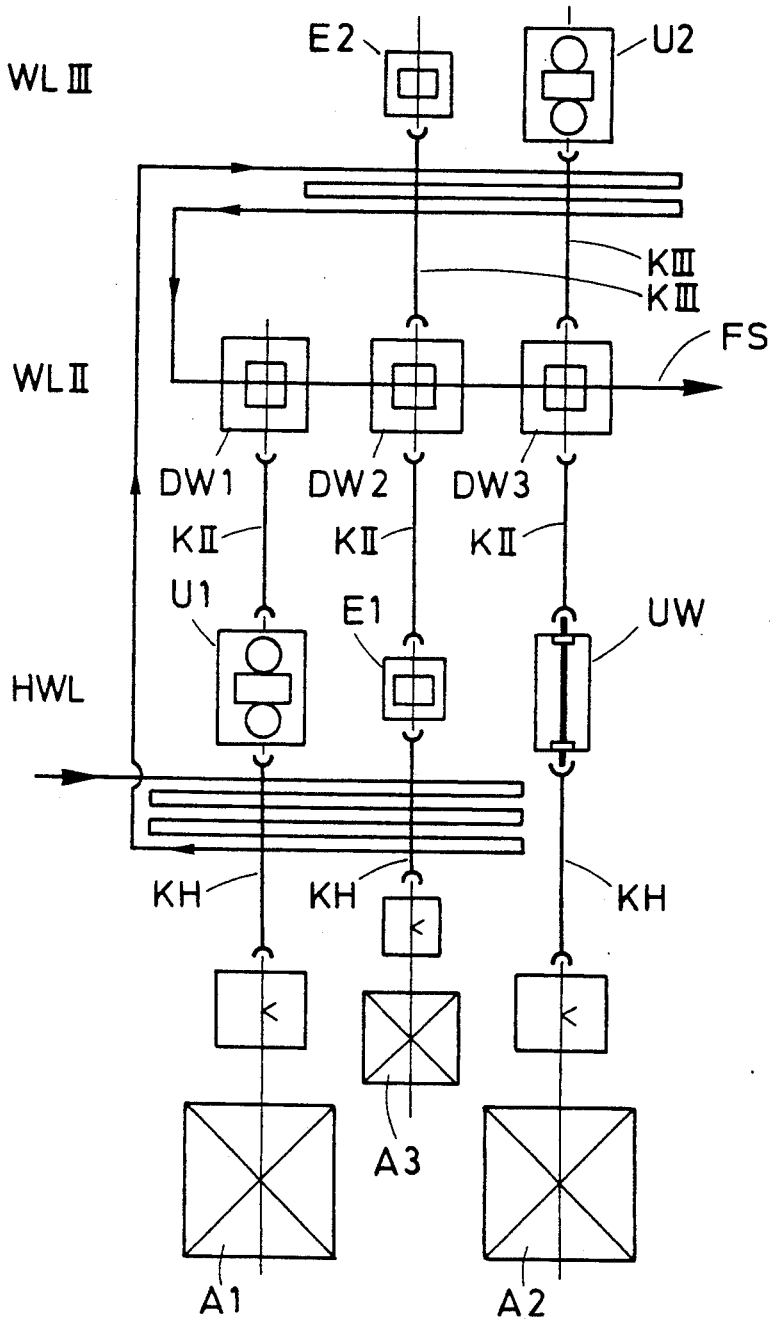
FIG. 2 is a schematic top view of a modification of the compact rolling mill in accordance with the invention with illustration of the pass course.

Turning now to FIG. 2 which shows a modification of the arrangement of the rolling stands according to FIG. 1, it can be seen that the universal rolling stand U2 is transferred by a crane from its position in the main rolling line HWL to a position in a same axial alignment in the third rolling line WLIII while the position of the universal rolling stand U2 in the main rolling line HWL is assumed by a shafting support UW. As shown in FIG. 2, all clutches KH, KII, KIII arranged between the individual rolling stands are in engaged position so that the drive forces of the three drive units Al, A2, A3 acting on the main rolling line HWL are transmitted to all stands in the three rolling lines HWL, WLII and WLIII.

Figure 3:
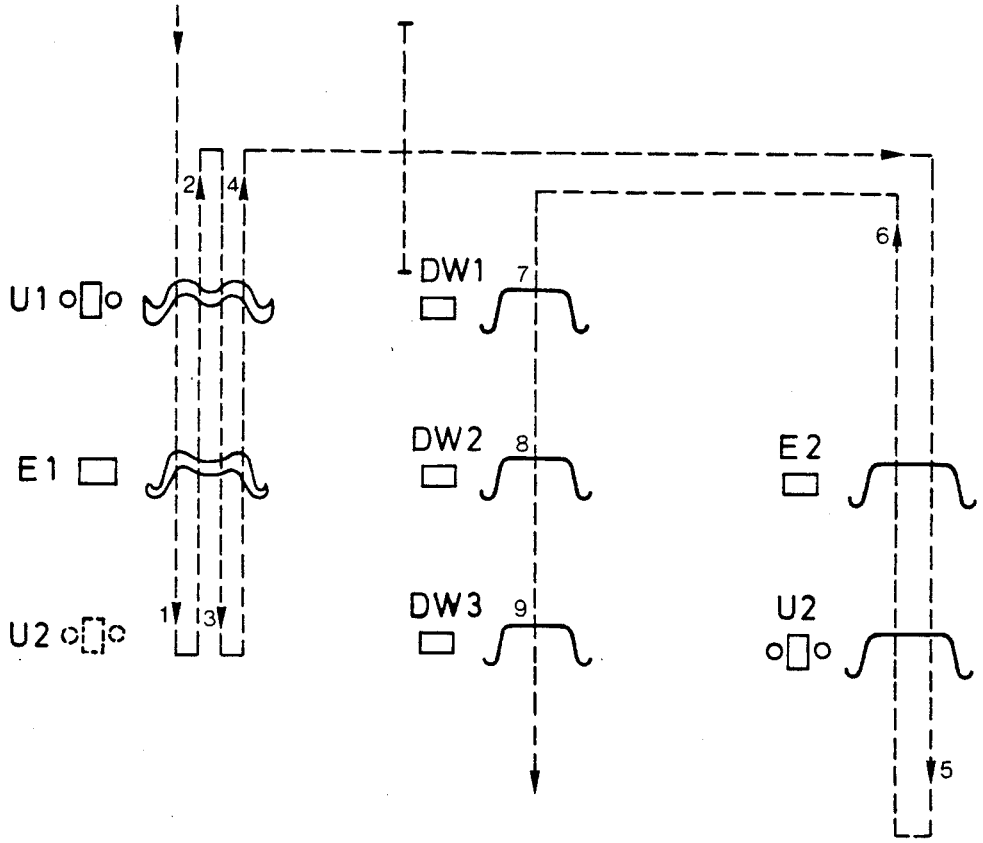
FIG. 3 is a schematic illustration of the compact rolling mill of FIG. 2 with illustration of the pass plan.

This arrangement of the rolling stands in the compact rolling mill train is provided for rolling sheet piles, and will now be described with reference to FIG. 3. The rolling stock having a continuous casting profile or a roughing roll profile is initially reversibly passed in the main rolling line HWL through the universal rolling stand U1 and the edging stand El to provide reversingly the first four shaping passes, and then is transferred via a transfer table (not shown) into the third rolling line WLIII to subject the rolling stock to further (two) reversing shaping passes through the two-high edging stand E2 and universal rolling stand U2 to essentially provide the sheet piles with the finished cross section. After being transferred to the second rolling line WLII, the rolling stock is passed through the finish-grooved two-high rolling stands DW1, DW2, DW3 and is finish-rolled with so-called "butterfly passes".

Although not shown in detail in the drawing the drive shafts of the rolling stands may be provided at roll side with axially displaceable guide sleeves and/or joint heads.

Figure 4:
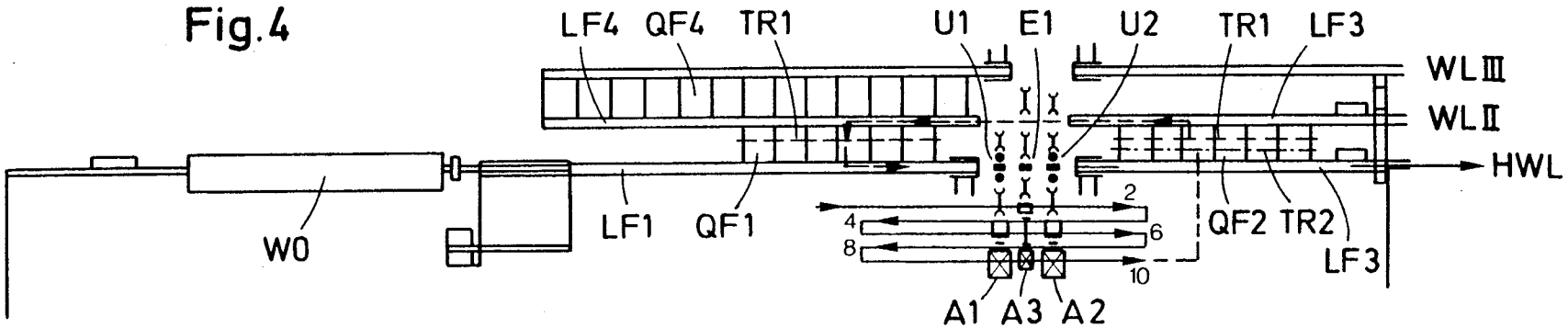
FIG. 4, is a schematic illustration of a compact rolling mill in accordance with FIG. 1.

Turning now to FIG. 4, there is shown a compact rolling mill with an arrangement of the rolling stands corresponding to the arrangement of FIG. 1 and used for rolling beams. This arrangement may, however, also be used for rolling beams in thermomechanic manner, as described above. The rolling stock coming from the heating furnace WO is transported by the longitudinal conveyor LF1 to the universal tandem compact stand group in the main rolling line HWL which includes both universal rolling stands U1, U2 and the intermediate two-high edging stand El. It will be appreciated, however, that the rolling stock may be directly fed from a continuous casting unit to this group if desired after preshaping the profile in one or more two-high roughing stands which may be arranged in the second rolling line WLII.

The beam TR1 which is indicated by broken line in FIG. 4 is rough-rolled in ten passes in the main rolling line HWL, placed on the longitudinal conveyor LF2 and then picked up by and placed on the cross conveyor QF2 until the beam TR2 indicated in dashdot line has been suitably rough-rolled and deposited on the cross conveyor QF2 at which point the beam TR1 is transferred to the longitudinal conveyor LF3 in the second rolling line WLII and from there to the longitudinal conveyor LF4 which extends in the same rolling line WLII. The beam TR1 is then transferred by means of the transfer table QF1 and returned onto the longitudinal conveyor LF1 in the main rolling line HWL for being transported to the group of stands U1, El, U2 for the finishing pass. After carrying out the finishing pass, the beam TR1 is discharged from the compact rolling mill train via the longitudinal conveyor LF2.

Instead of being deposited on the cross conveyor QF2 for cooling purposes e.g. by means of natural or additional air cooling and/or water cooling, the beam may also be placed on the cross conveyor QF1 if such would be desirable for the sequence of the passes. For such intermediate steps, in addition to the cross conveyors LF3 and LF4, the cross conveyor QF4 which leads to the third rolling line WLIII may be used.

Figure 5:
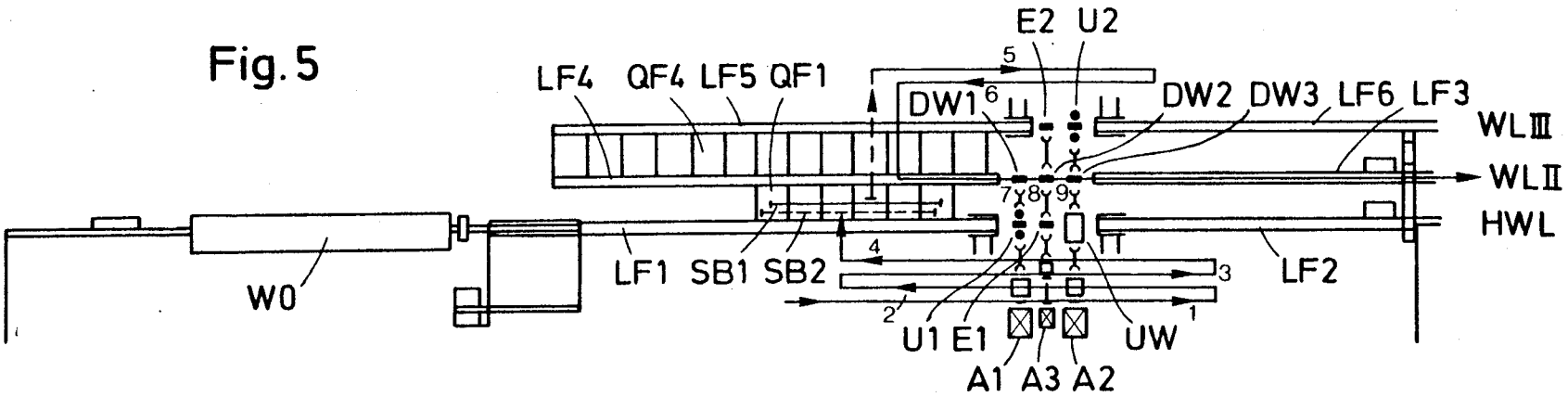
FIG. 5 is a schematic illustration of a compact rolling mill in accordance with FIG. 2.

FIG. 5 shows an arrangement of rolling stands for the thermomechanic rolling of sheet piles which corresponds to the arrangement in accordance with FIG. 2. The rolling stock of precast or preformed cross section—after being discharged from the heating furnace WO—is transported by the longitudinal conveyor LF 1 to the group of rolling stands of universal rolling stand U1 and two-high edging stand E1 in the main rolling line HWL and is rough-rolled e.g. in four passes. The rolling stock in form of a preformed sheet pile SB1 as indicated by continuous line is transferred to the cross conveyor QF1. During rolling of the subsequent sheet pile SB2 through the same group of rolling stands and then transfer of the sheet pile SB2—illustrated in broken line—to the cross conveyor QF1, the preformed sheet pile SB1 which has been cooled down in controlled manner is transferred to the cross conveyor QF4 between the second rolling line WLII and the third rolling line WLIII for transport and depositing of the sheet pile SB1 onto the longitudinal conveyor LF5 in the third conveyor line WLIII. The longitudinal conveyor LF5 transports the sheet pile SB1 to the rolling stand group of edging stand E2 and universal rolling stand U2 in the rolling line WLIII for two more shaping passes, and then the sheet pile SB1 is transferred after being taken over from the longitudinal conveyor LF5 by the cross conveyor QF4 to the longitudinal conveyor LF4 in the second rolling line WLII for being transported to the two-high rolling stand group DW1, DW2, DW3 for continuously finish-rolling the preshaped sheet pile SB1. Thereafter, the latter is discharged via the longitudinal conveyor LF3. Cooling of the sheet piles is attained on the cross conveyor QF2 between the main rolling line HWL and the second rolling line WLII.

Figure 6:
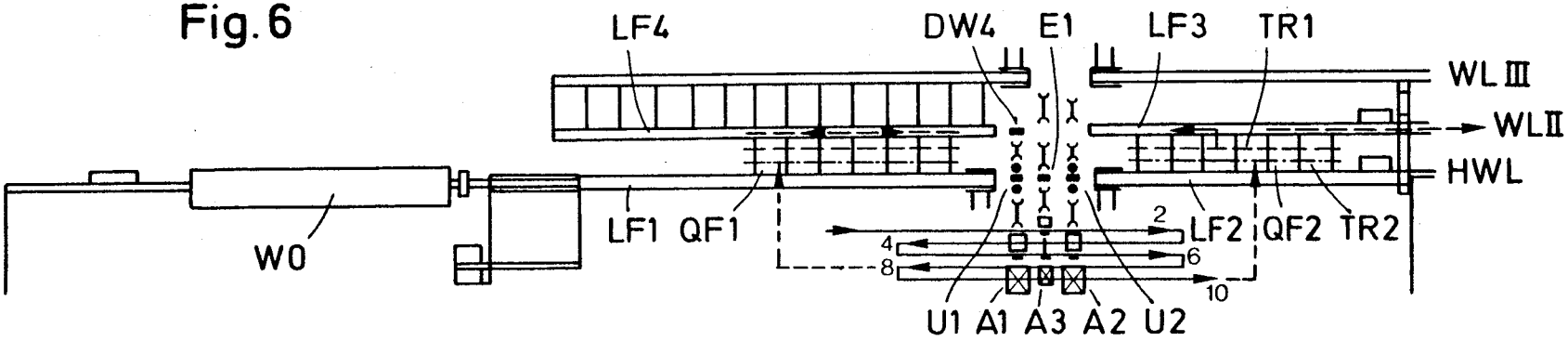
FIG. 6 is a schematic illustration of a modified compact rolling mill according to FIG. 5.

Turning now to the arrangement of the compact rolling mill train as shown in FIG. 6 which differs from the arrangement of FIG. 4 by an additional two-high rolling stand DW4 positioned in the second rolling line WLII in axial alignment with one of the two universal rolling stands in the main rolling line HWL and provided for the stem finishing pass or passes. The preceding roll passes of the initially rolled beam TR1 as indicated by broken line are carried out by the universal tandem compact stand group U1, El and U2 in the main rolling line HWL in a same manner as described with reference to FIG. 4. Then, the beam TR1 is picked up from the longitudinal conveyor LF2 by the cross conveyor QF2 where it remains until the subsequent beam TR2 as indicated in dash-dot line has been subjected to the respective number of passes and picked up in a same manner by the cross conveyor QF2 at which point the beam TRl placed on the cross conveyor QF2 is transferred to the longitudinal conveyor LF3 in the second rolling line WLII for providing in this rolling line the finishing pass through the two-high rolling stand DW 4. Depending on the number of passes, the arrangement of FIG. 6 allows to deposit and to cool the beams on either one of the cross conveyor QF1 or QF2 cooperating with the longitudinal conveyors LF1 or LF2 of the main rolling line HWL, and then to transfer the beams onto either one of the longitudinal conveyors LF3, LF4 of the second rolling line WLII for finish-rolling with a finishing pass from either direction. This is attained in the arrangement of FIG. 6 by designing the two-high rolling stand DW4 as two-high horizontal stand by which the final size of the beam stem is rolled in.

Figure 7:
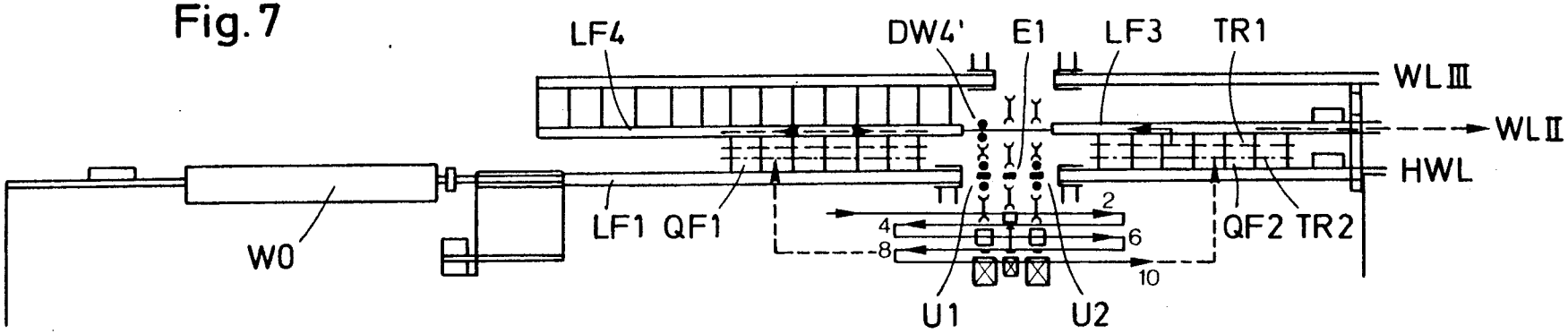
FIG. 7 is a schematic illustration of a modified compact rolling mill according to FIG. 6.

In the arrangement of FIG. 7, the two-high rolling stand DW4 is designed in form of a vertical stand by which the final size of the flange thickness is rolled in. It will be readily recognized that it is certainly possible to substitute such different two-high rolling stands by a universal rolling stand if the operating conditions allow.

Figure 8:
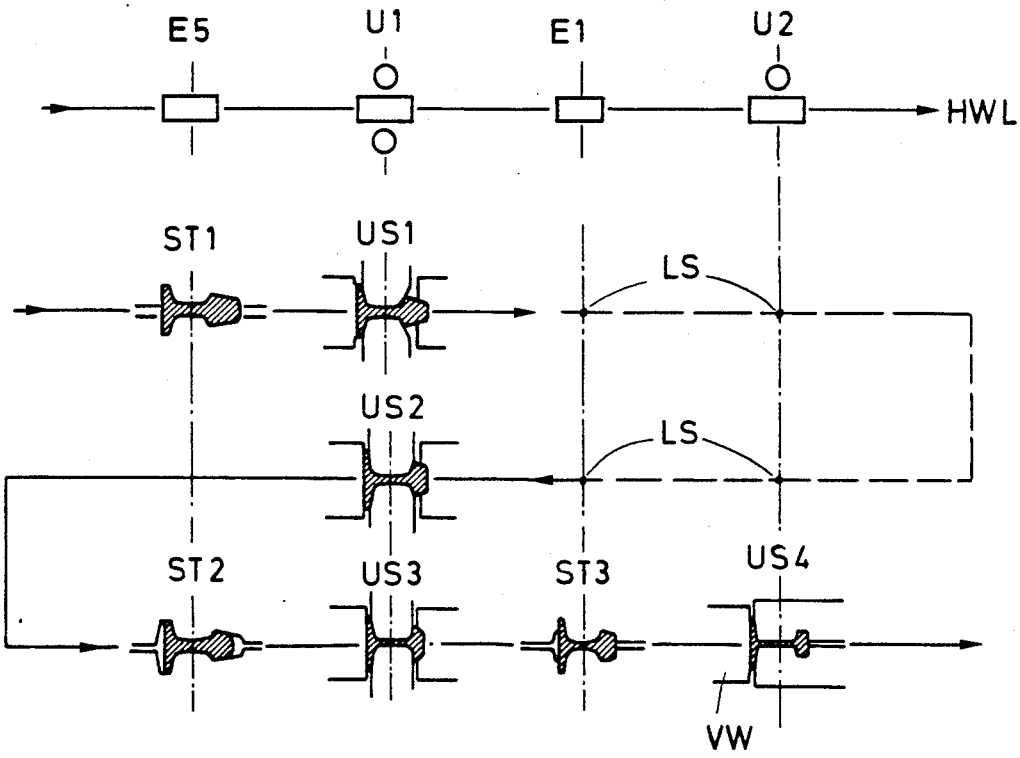
FIGS. 8 to 18 show further arrangements of a compact rolling mill in accordance with FIGS. 1 and 2 with illustration of the passes.

FIG. 8 shows an arrangement of a compact rolling mill for rolling rails and includes a universal tandem compact stand group U1, El, U2 positioned in a rolling line, suitably the main rolling line HWL and a two-high edging stand E5 which is arranged at close distance preceding the compact stand group U1, El, U2. Following the edging pass ST as guide pass through the two-high edging rougher E5 is a universal pass US1 on the subsequent universal rolling stand U1, and two dummy passes LS via the opened two-high edging stand El and the opened other universal rolling stand U2. After reversing and two further dummy passes LS via the opened two-high edging stand El and the opened other universal rolling stand U2, a further universal pass US2 is provided through the universal rolling stand U1. These passes are followed, after reversing, by a second edging pass ST2 through the two-high edging rougher E5 at same groove as the preceding pass on this stand, by an universal pass US3 through the universal rolling stand U1, a third edging pass ST3 through the two-high edging stand El and the finishing pass as universal pass US4 through the universal rolling stand U2. As is common in rail rolling, the finishing pass is provided with only one vertical roll VW of the universal rolling stand U2 for finishing the rail flange.

Figure 9:
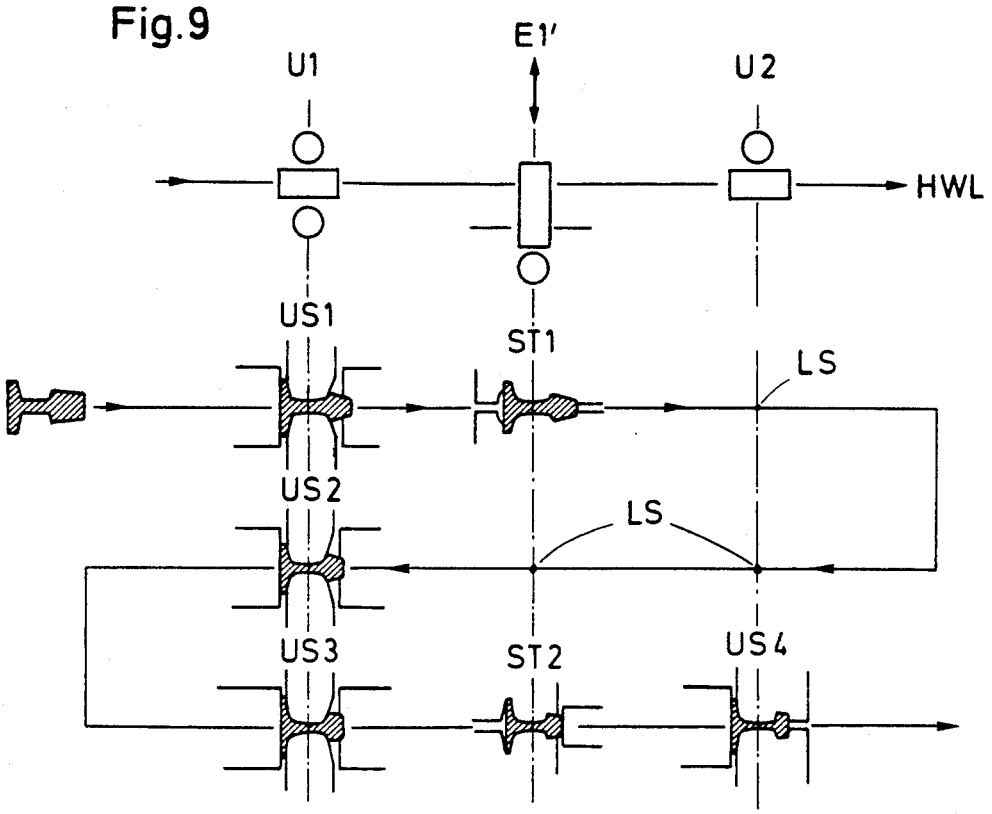

FIG. 9 illustrates an arrangement of the rolling stands which differs to the arrangement of FIG. 8 in that the two-high edging stand E1' which is disposed between the two universal rolling stands U1, U2 includes two edging grooves and is slidable transversely for introducing the groove in the main rolling line HWL. The guide pass (not shown) is followed by an universal pass US1 through the universal rolling stand U1, a first edging pass US1 through the two-high edging stand E1' two reversing dummy passes LS through the universal rolling stand U2, a further dummy pass LS through the two-high edging stand E1' and then by a second universal pass US2 through the universal rolling stand U1 and, after reversing, a further universal pass US3 through the rolling stand U1. The universal pass US3 is then followed by the second edging pass ST2 through the other groove of the respectively displaced two-high edging stand El" and by the finishing pass as universal pass US4 through the universal rolling stand U2. A vertical auxiliary roll provided in the two-high edging stand provides the rail head edging.

Figure 10:
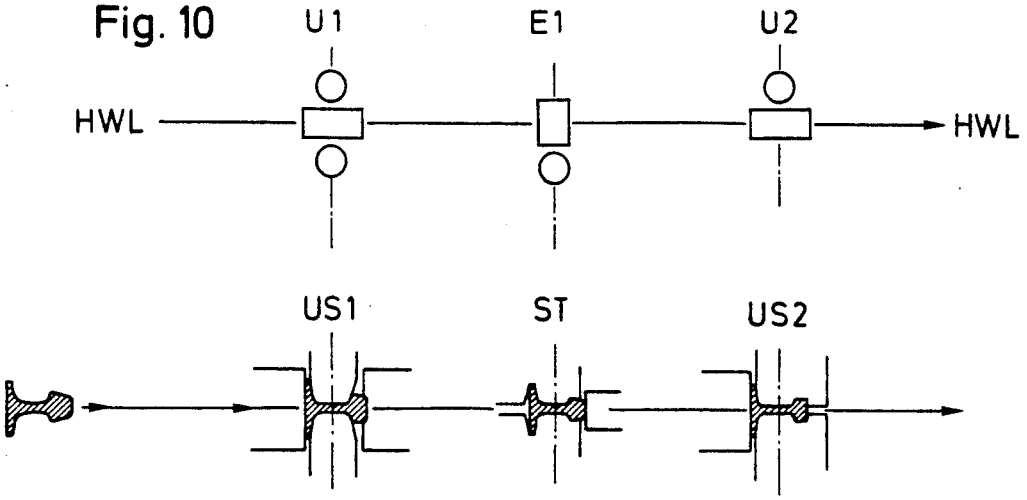

The arrangement according to FIG. 10 shows, however, that it is certainly possible to continuously roll the rolling stock by means of an universal tandem stand group with non-displaceable two-high edging stand El and the two universal rolling stands U1, U2 in such a manner that the profile coming from the two-high rougher is rolled in the main rolling line HWL via an universal pass US1 through the universal rolling stand U1, an edging pass ST through the two-high edging stand El with rail head edging as shown in FIG. 9 and an universal pass US2 as finishing pass through the universal rolling stand U2.

Figure 11:
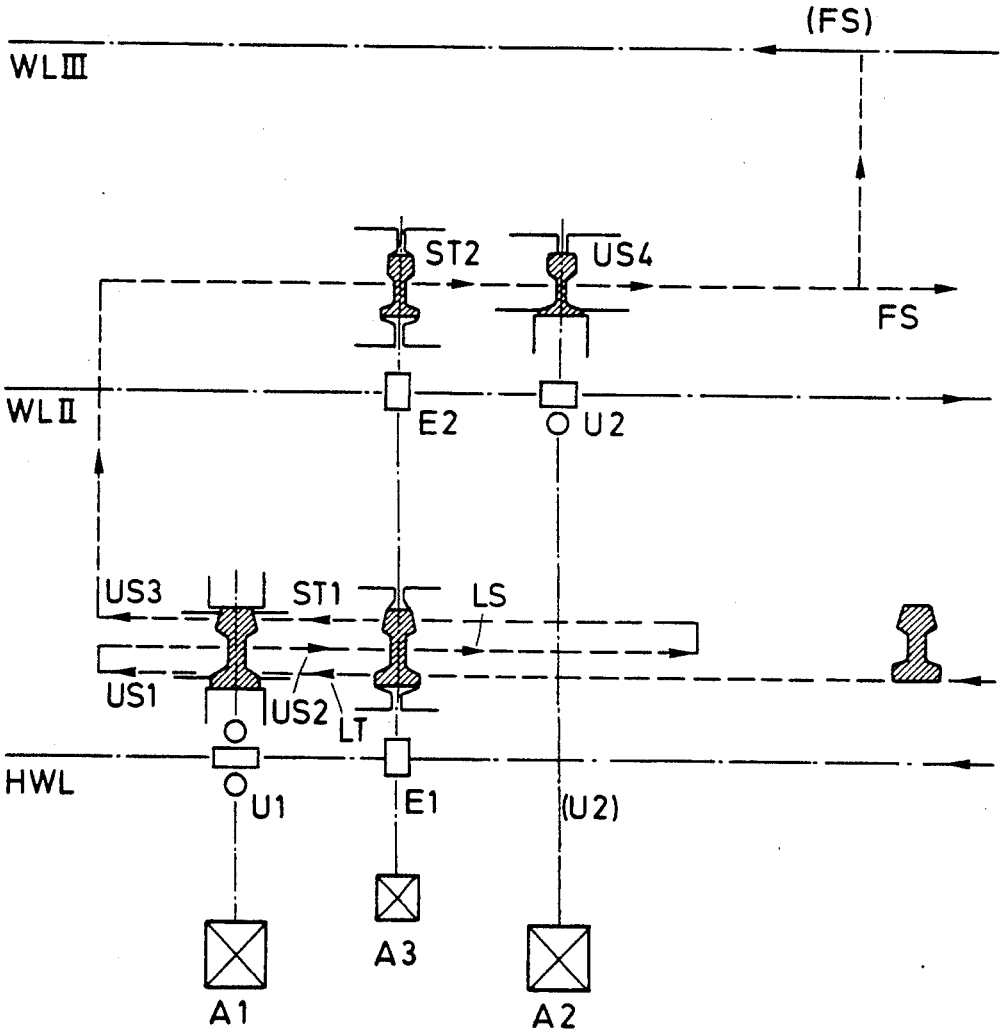

FIG. 11 shows a compact rolling mill in which the rolling stands are positioned in the main rolling line HWL and in the second rolling line WLII, with one of both universal rolling stands U2 of the universal tandem compact stand group U1, El, U2 being positioned in the second rolling line WLII in axial alignment with its original position (U2) in the main rolling line and with a second two-high edging stand being positioned in the second rolling line WLII in axial alignment with the two-high edging stand El and driven in a manner previously described.

The profile coming from the two-high roughing stand (not shown) is initially subjected in the two-high edging stand to an edging pass as guide pass LT which is followed by an universal pass US1 through the universal rolling stand U1 and after reversal by a second universal pass US2 through the same stand, by a dummy pass LS through the two-high edging stand El which after reversal provides an edging pass ST1 followed by a further universal pass US3 through the universal rolling stand U1. The rolling bar is then transported by a cross conveyor (not shown) into the second rolling line WLII for providing a further edging pass ST2 through the two-high edging stand E2 and subsequently a universal pass US4 as finishing pass FS through the universal rolling stand U2 in the same rolling line WLII. The delivery of the finished rail may be obtained opposite to the feeding direction in the second rolling line WLII or via a cross conveyor in feeding direction of the third rolling line WLIII.

Figure 12:
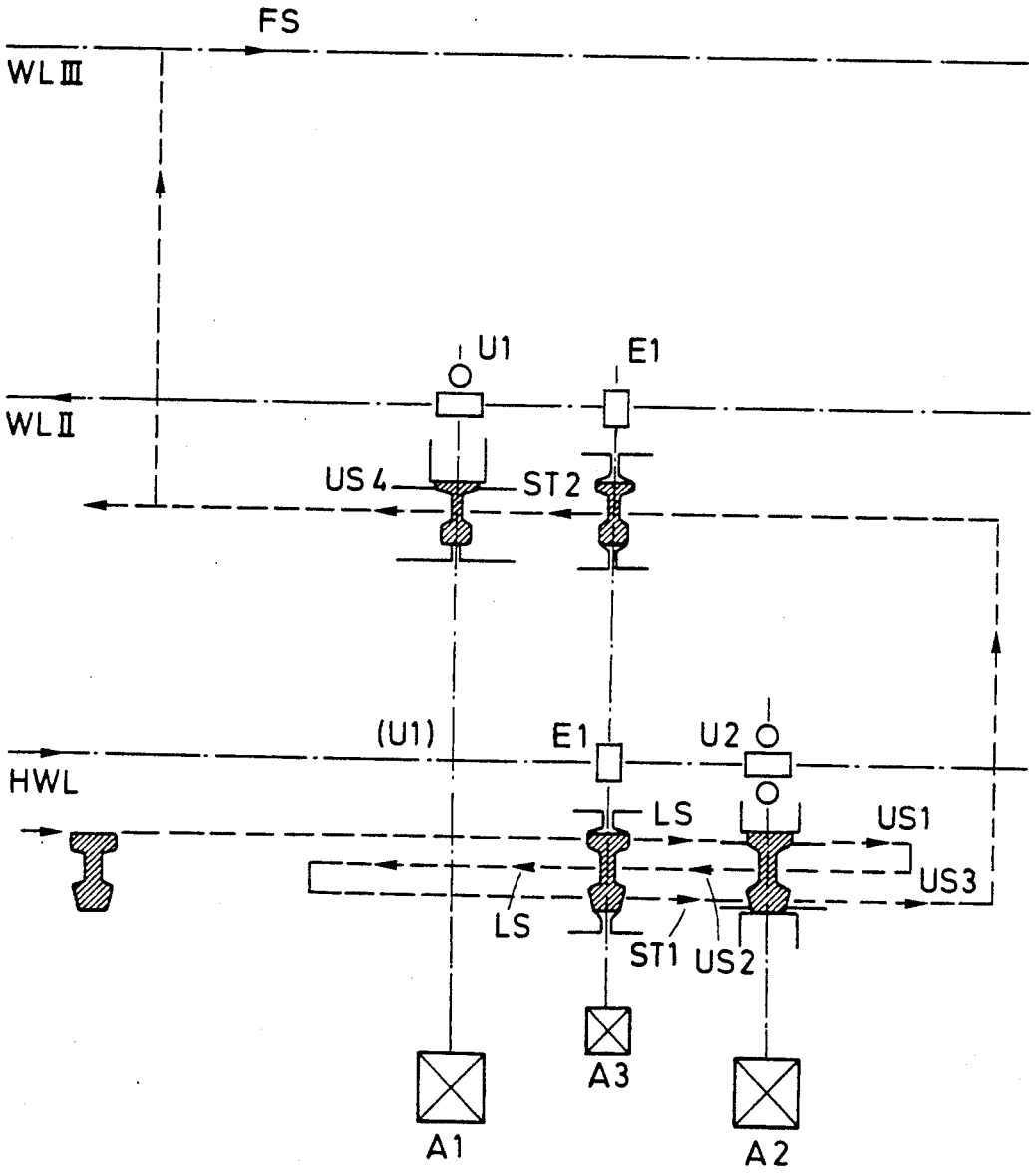

FIG. 12 illustrates a compact rolling mill with an arrangement of the rolling stands differing from FIG. 11 only by positioning the universal rolling stand U1 of the universal tandem compact stand group U1, El, U2 in the second rolling line WLII instead of positioning the universal rolling stand U2 in the main rolling line HWL. The pass sequence is thus merely reversed in comparison to the arrangement of the rolling stands according to FIG. 11.

Figure 13:
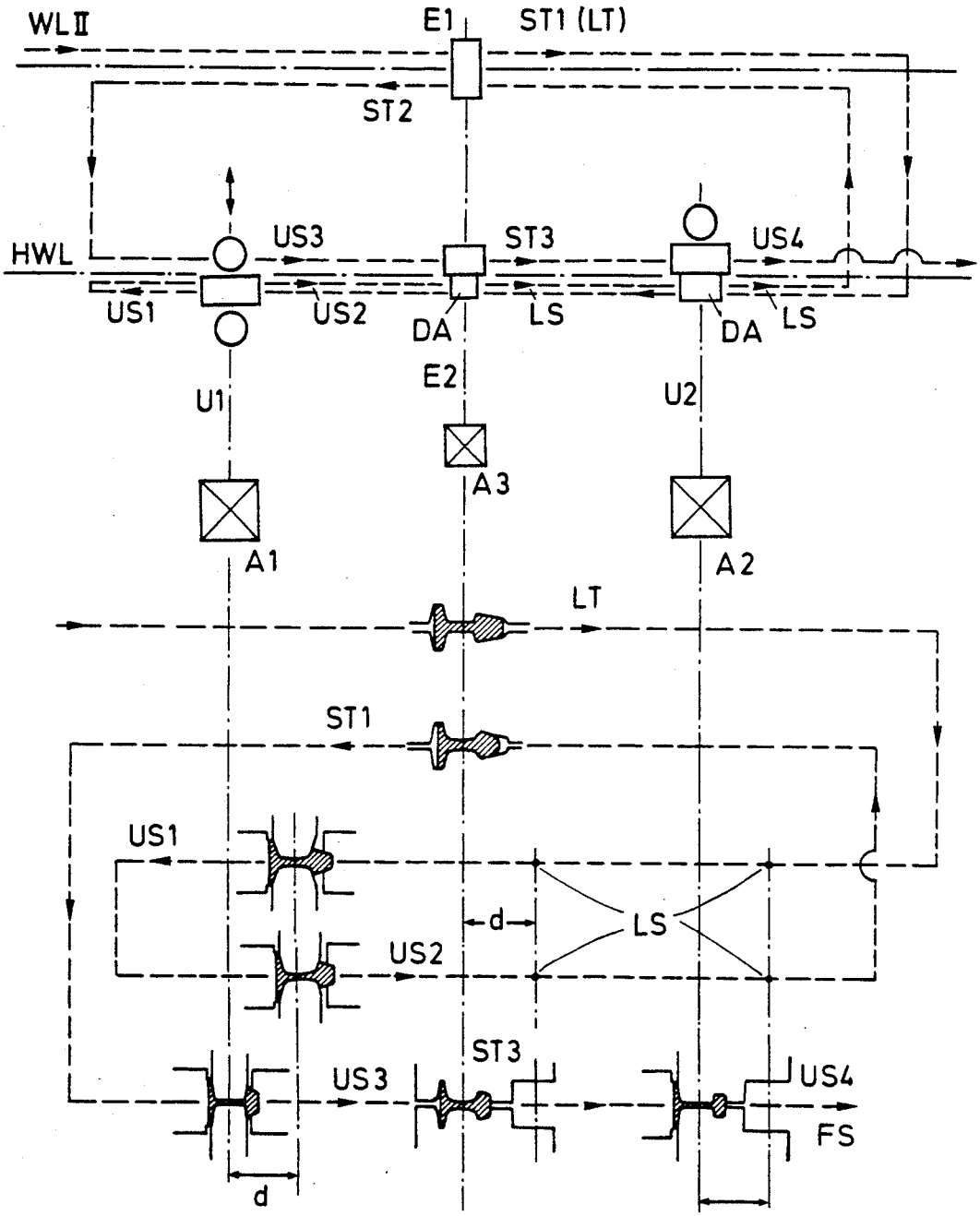

In the arrangement of the rolling stands in the compact rolling mill according to FIG. 13, one of the universal rolling stands e.g. the universal rolling stand U2 and the two-high edging stand E2 of the universal tandem compact stand group are equipped with horizontal rolls which include offset passages DA for dummy passes without requiring any modification of the roll adjustment. The second rolling line WLII includes a further two-high edging stand E1 in axial alignment with the two-high edging stand E2. The other universal rolling stand U1 of the universal tandem compact stand group U1, E2, U2 can be positioned by transversely shifting the rolls or the rolling stand before the dummy pass or rolling pass of the stands E2+U2. An edging pass ST1 as guide pass (LT) is carried out in the two-high edging stand El in the second rolling line WLII and after conveying the rolling stock in transverse direction into the main rolling line HWL is followed by dummy passes LS through the universal rolling stand U2 and two-high edging stand E2, by a universal pass US1 in the same rolling line HWL through the universal rolling stand U1, after reversal, by a further universal pass US2 in this stand as well as by dummy passes LS through the two-high edging stand E2 and the universal rolling stand U2 in the same rolling line. After conveying the rolling stock in transverse direction back into the second rolling line WLII, a further edging pass ST2 is provided through the two-high edging stand El, and after renewed transport in transverse direction back into the main rolling line HWL, a third universal pass US3 is provided in the other groove of the universal rolling stand U1 after the latter has been shifted by the distance d. The universal pass US3 is the followed by an edging pass ST3 through the two-high edging stand E2 and by a universal pass US4 as finishing pass through the universal rolling stand U2 in this rolling line HWL.

Figure 14:
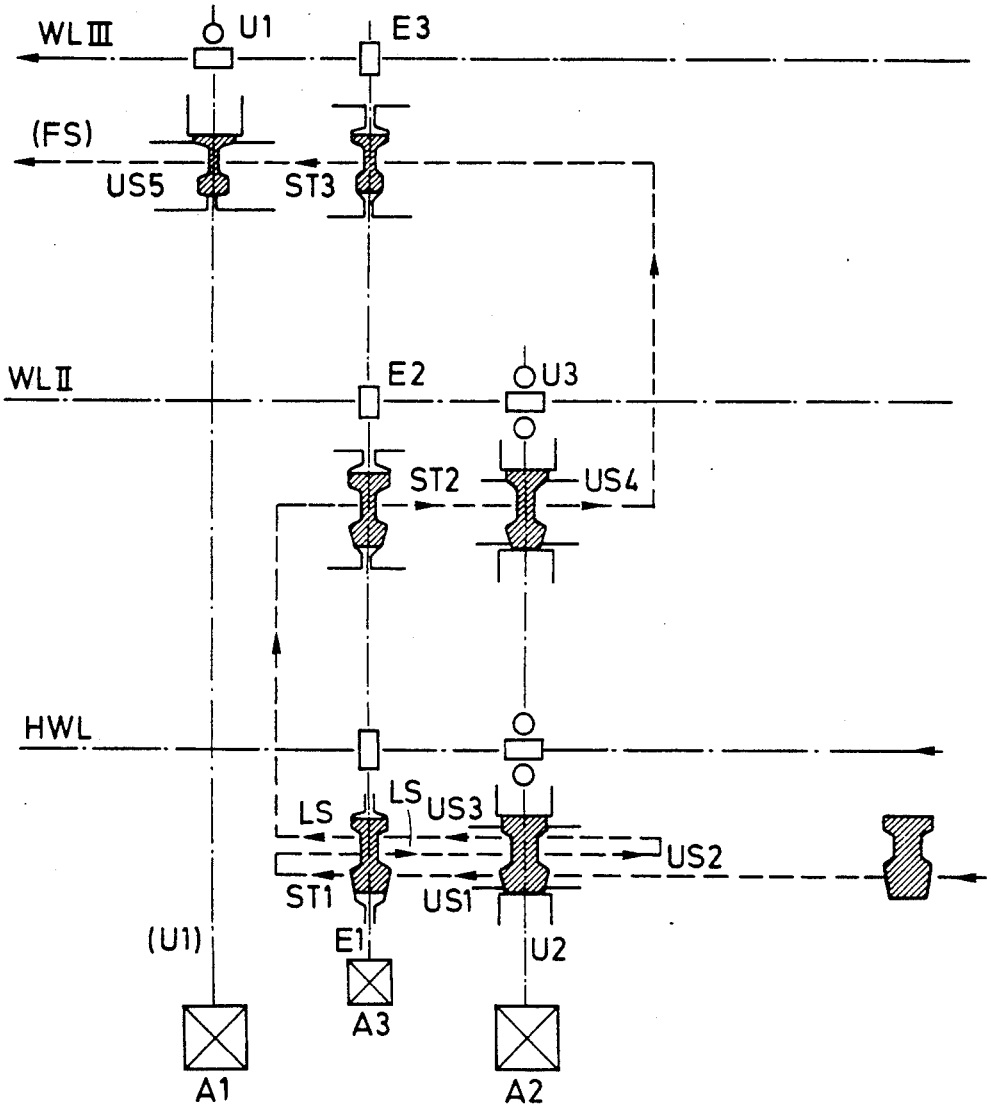
Figure 15:
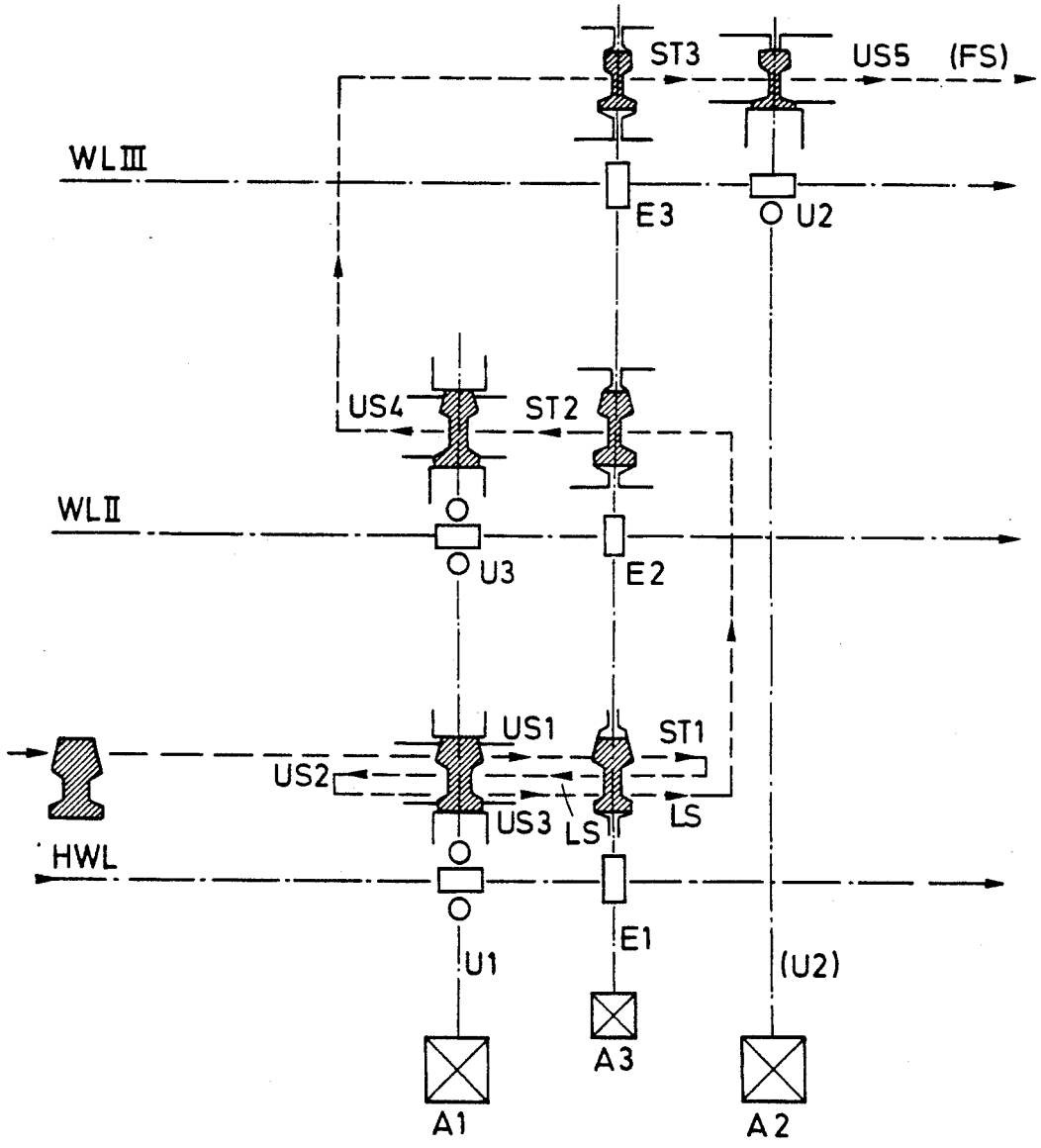

FIGS. 14 and 15 show a compact rolling stand in which a universal rolling stand is positioned in each of the three rolling lines, i.e. universal rolling stand U2 in the main rolling line HWL, universal rolling stand U3 in the second rolling line WLII, universal rolling stand U1 in the third rolling line WLIII. Preceding or succeeding each of these rolling stands U2, U3, U1 is a two-high edging stand E1, E2, E3. With such an arrangement, the preshaped profile can be rolled in the main rolling line HWL with an universal pass US1 through the universal rolling stand U2 and subsequently with an edging pass ST1 through the two-high edging rolling stand El in the same rolling line, followed, after reversal, by a dummy pass LS through the same stand E1 and by a second universal pass US2 through the universal rolling stand U2. After reversing follows a third universal pass US3 through the same stand U2 and a dummy pass LS through the two-high edging stand El. After conveying the rolling stock in transverse direction from the main rolling line HWL into the second rolling line WLII, an edging pass ST2 through the two-high edging stand E2 and a universal pass US4 through the universal rolling stand U3 are successively provided which are followed after renewed transverse conveyance of the rolling stock from the second rolling line WLII into the third rolling line WLIII by a further edging pass ST3 through the two-high edging stand E3 and by a finishing pass FS as universal pass US5 through the universal rolling stand U1.

The arrangement of the rolling stands according to FIG. 15 is a mirror image of the arrangement according to FIG. 14 and thus its pass sequence corresponds to the pass sequence of FIG. 14.

Figure 16:
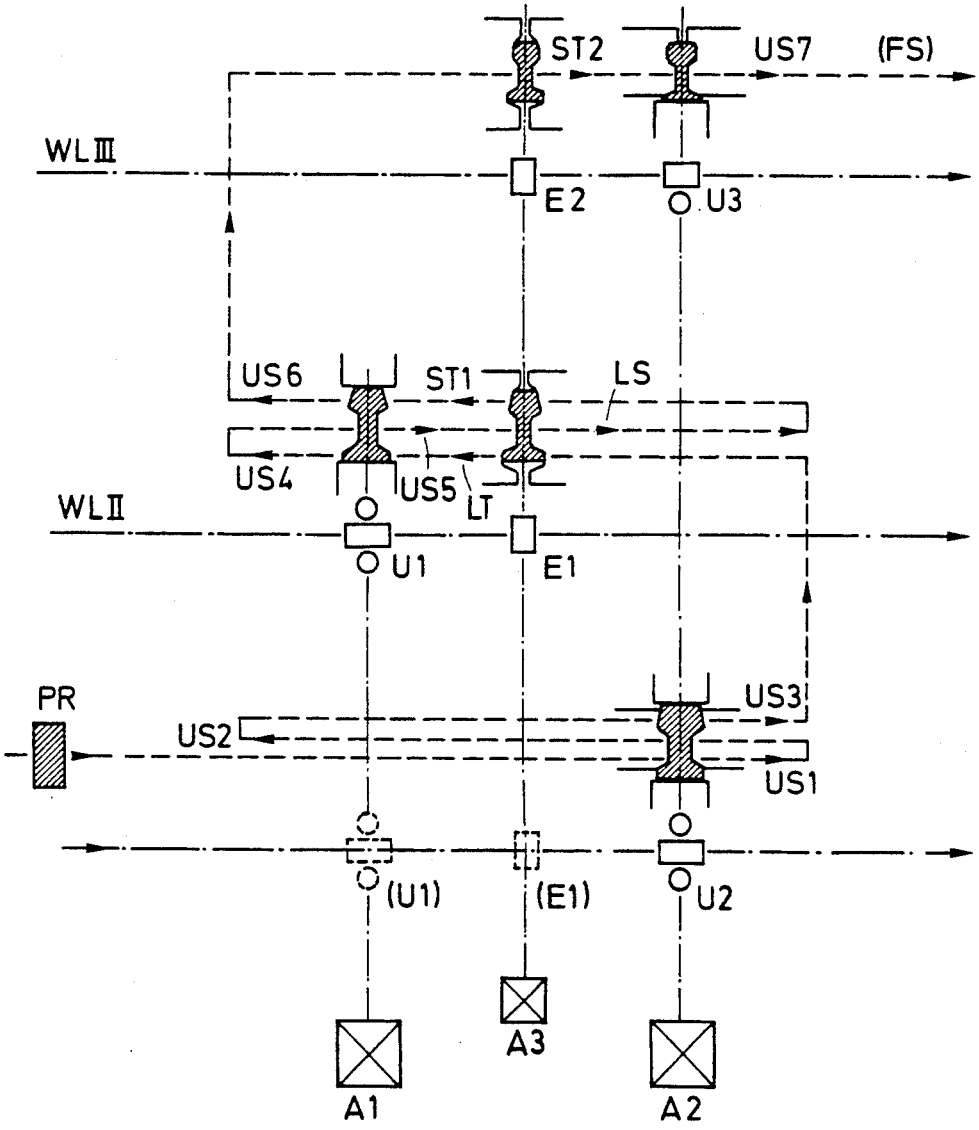

The arrangement of the rolling stands of the compact rolling mill according to FIG. 16 is similar to the arrangement according to FIG. 15. The only difference resides in the fact that the main rolling line HWL includes only one universal rolling stand U2. The precast profile PR coming from a continuous casting unit and possibly roughed is rough-rolled in the main rolling line HWL with three reversing universal passes US1, US2, US3 through the universal rolling stand U2, then transferred via a cross conveyor to the second rolling line WLII for providing an edging pass as leader pass LT through the two-high edging stand E1. This is followed by a further universal pass US4 through the universal rolling stand U1 in the same rolling line. After reversing, the rolling stock is subjected to a further universal pass US5 through the universal rolling stand U1, then to a dummy pass LS through the two-high edging stand El in the same rolling line WLII and, after reversing, to a first edging pass ST1 through the two-high edging stand El. The edging pass ST1 is followed by a further universal pass US6 through the universal rolling stand U1 in the rolling line WLII. Subsequently, the rolling stock is transported in transverse direction into the third rolling line WLIII and after being subjected to an edging pass ST2 through the two-high stand E2 is finish-rolled in a universal pass US7 as finishing pass FS with the universal rolling stand U3.

Figure 17:
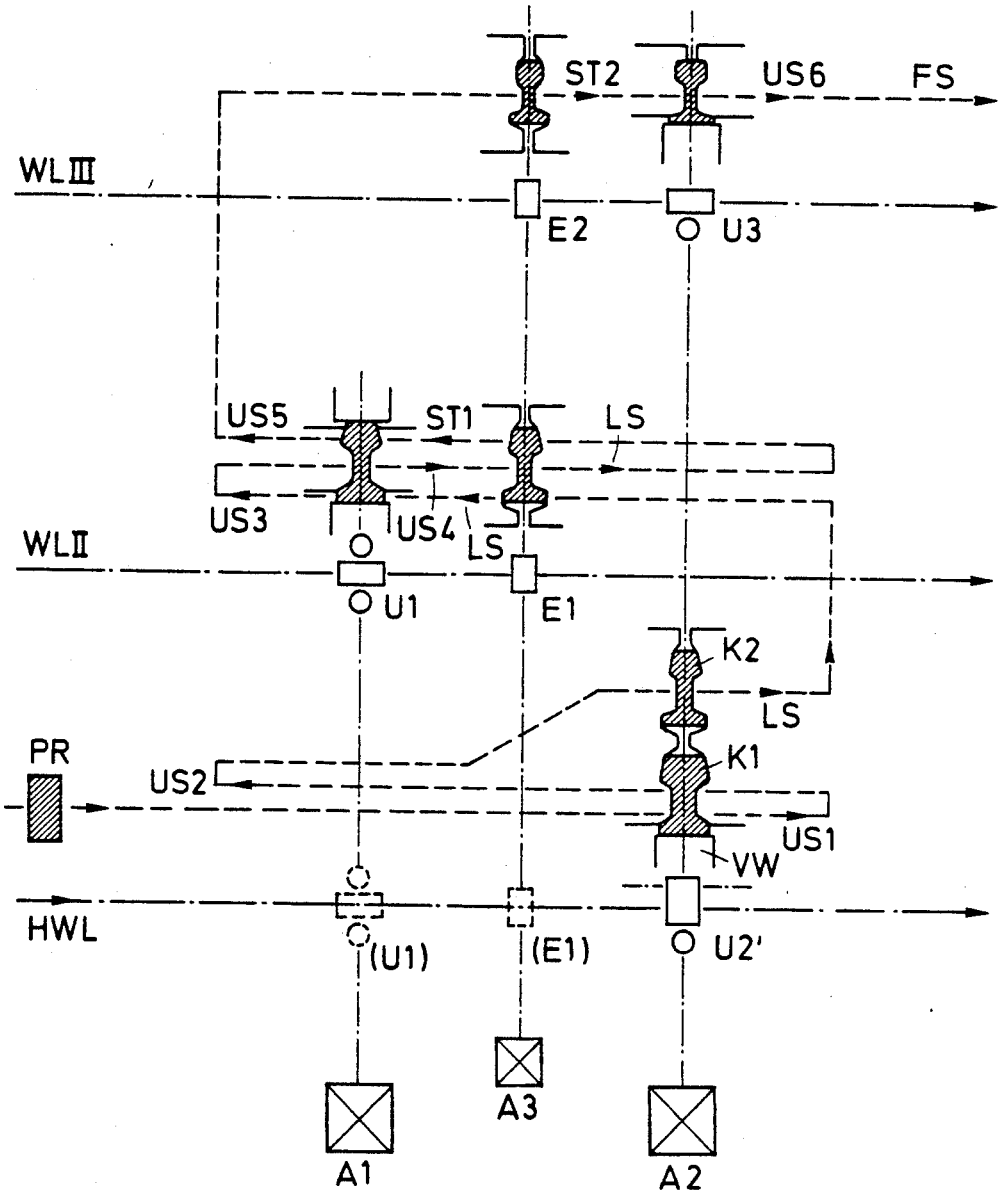

The compact rolling mill according to FIG. 17 differs from the compact rolling mill of FIG. 16 only by arranging in the main rolling line HWL a universal rolling stand U2' which includes two grooves. The first universal pass US1 and, after reversing, the second universal pass US2 are guided through the first groove K1, with the rail foot area being acted upon by a vertical roll VW of the rolling stand U2'. The following pass which is the guide pass LT is provided in the second groove K2 of the rolling stand U2' and is actually an edging pass since the vertical roll VW of the rolling stand U2' remains ineffective. After being conveyed in transverse direction into the second rolling line WLII, the rolling stock is subjected to a dummy pass LS instead of the first edging pass ST1 in the two-high edging stand El according to the arrangement of FIG. 16. The following passes then correspond to the sequence of passes as described in connection with the compact rolling mill of FIG. 16 and include in succession a universal pass US3 and after reversing a universal pass US4 through the universal rolling stand U1, a dummy pass LS, and after reversing an edging pass ST1 through the two-high edging stand E1, a universal pass US5 through the universal rolling stand U1. After transfer from the second rolling line WLII to the third rolling line WLIII, the rolling stock is subjected to a second edging pass ST2 through the two-high edging stand E2 and to a universal pass US6 as finishing pass FS through the universal rolling stand U3.

Figure 18:
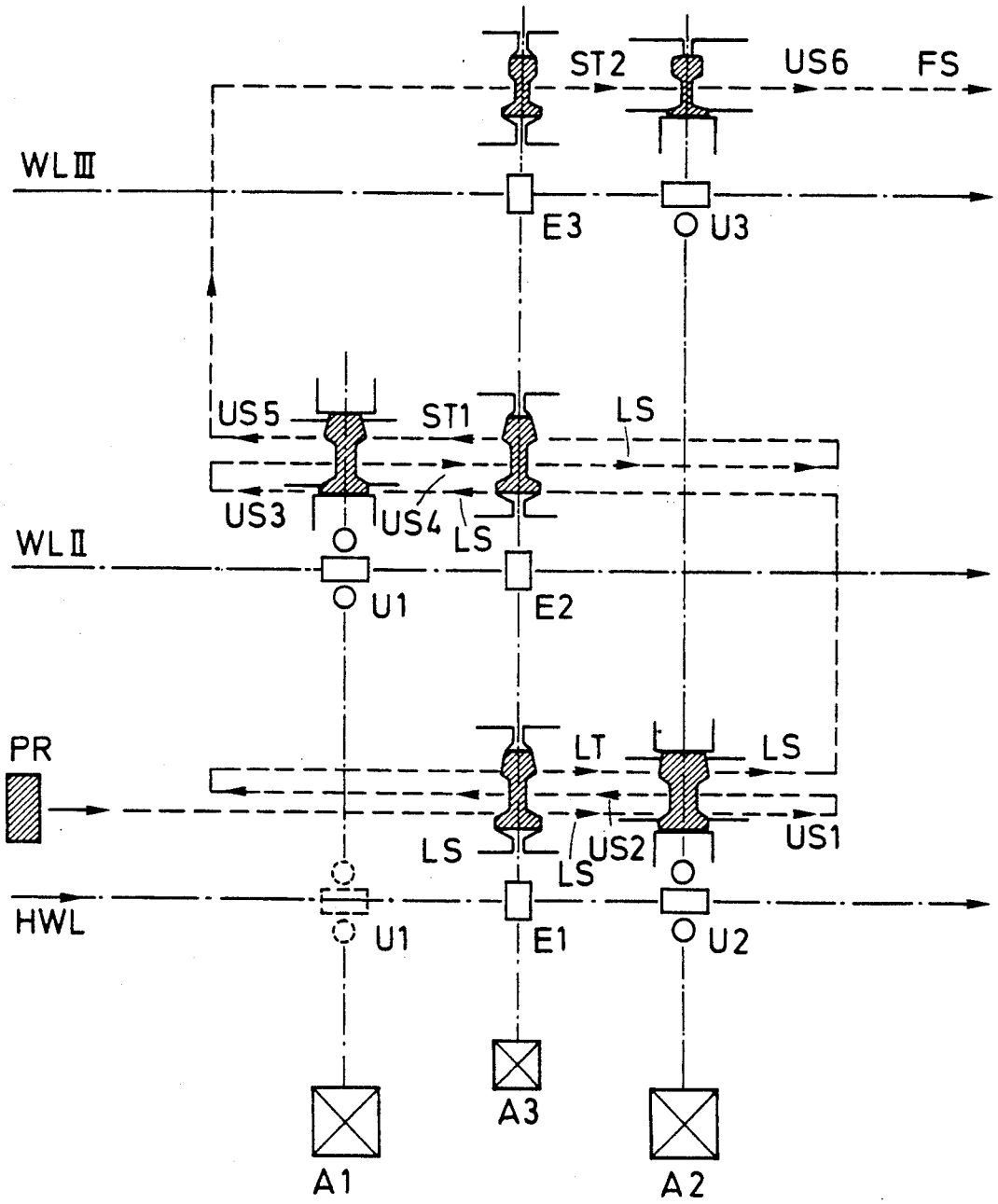

Turning now to FIG. 18, there is shown a compact rolling mill which includes an edging stand El prior to the universal rolling stand U2 in the main rolling line HWL. Still, the first pass of the precast or preformed profile PR is provided in the universal rolling stand U2 since the passage through the preceding two-high edging stand E1 is a dummy pass LS as is the passage through the two-high edging stand E1 after the reversing second universal pass US2 in the universal rolling stand U2 has been carried out. The subsequent reversing edging pass through the two-high edging stand El represents the guide pass LT and is followed by a dummy pass LS in the universal rolling stand U2. After being conveyed in transverse direction from the main rolling line HWL into the second rolling line WLII, the rolling stock is subjected to a sequence of passes corresponding to the pass sequence described in connection with the arrangement of FIG. 17, and thus is subjected in succession to a dummy pass through the two-high edging stand E2, a universal pass US3 and after reversing a universal pass US4 through the universal rolling stand U1, a dummy pass LS, and after reversing an edging pass ST1 through the two-high edging stand E2, a universal pass US5 through the universal rolling stand U1. After transfer from the second rolling line WLII to the third rolling line WLIII, the rolling stock is subjected to a second edging pass ST2 through the two-high edging stand E3 and to a universal pass US6 as finishing pass FS through the universal rolling stand U3.

While the invention has been illustrated and described as embodied in a compact rolling mill, it is not intended to be limited to the details shown since various modifications and structural changes may be made without departing in any way from the spirit of the present invention.

What is claimed as new and desired to be protected by Letters Patent is set forth in the appended claims:

1. A rolling mill for rolling sections, comprising a universal tandem compact stand group with at least two universal roll stands and a two-high roll stand, additional universal roll stands and two-high roll stands, the stands being arranged in rolling positions on at least three rolling lines extending in a rolling direction, the stands having axes extending transversely of the rolling direction, means for displacing the sections in the direction of the rolling lines and means for displacing the sections transversely of the rolling lines, means for displacing the stands in the direction of the rolling lines and means for displacing the stands transversely from one of the rolling lines to another of the rolling lines, driving means arranged adjacent the rolling positions of an outermost of the rolling lines, and coupling means for coupling the driving means with the stands and with transmission means arranged in the rolling positions which are located adjacent the driving means and adjacent each other in axial direction of the stands.

2. The rolling mill according to claim 1, wherein the universal tandem compact stand group is arranged on a first of the rolling lines, three two-high roll stands are arranged on a second of the rolling lines and a two-high edging stand is arranged on a third of the rolling lines, wherein the coupling means couples the two-high roll stands through the roll stands of the universal tandem compact stand group to the driving means, and wherein the coupling means couples the two-high edging stand through one of the two-high roll stands and through one of the stands of the universal tandem compact stand group to the driving means.

* * * * *